US008429872B2

(12) United States Patent
Pervan

(10) Patent No.: US 8,429,872 B2
(45) Date of Patent: Apr. 30, 2013

(54) BUILDING PANEL WITH COMPRESSED EDGES AND METHOD OF MAKING SAME

(75) Inventor: Darko Pervan, Viken (SE)

(73) Assignee: Valinge Innovation Belgium BVBA, Brussels (BE)

( * ) Notice: Subject to any disclaimer, the term of this patent is extended or adjusted under 35 U.S.C. 154(b) by 0 days.

(21) Appl. No.: 11/822,692

(22) Filed: Jul. 9, 2007

(65) Prior Publication Data

US 2008/0034701 A1 Feb. 14, 2008

Related U.S. Application Data

(63) Continuation of application No. 10/906,356, filed on Feb. 15, 2005, now Pat. No. 8,215,078.

(51) Int. Cl.
*E04B 2/00* (2006.01)

(52) U.S. Cl.
USPC ..... 52/592.1; 52/782.1; 428/192

(58) Field of Classification Search ..... 52/592.1, 52/782.1; 428/192; 144/346, 349–352; 29/897, 29/897.32, 458, 525.01, 525.13
See application file for complete search history.

(56) References Cited

U.S. PATENT DOCUMENTS

| | | | | |
|---|---|---|---|---|
| 1,568,605 | A | 1/1926 | Hough | |
| 1,790,178 | A * | 1/1931 | Sutherland, Jr. | 162/117 |
| 2,082,186 | A | 6/1937 | Staude | |
| 2,269,926 | A | 1/1942 | Crooks | |
| 2,497,837 | A | 2/1950 | Nelson | |
| 2,679,231 | A | 5/1954 | Pomper et al. | |
| 2,791,983 | A | 5/1957 | Driskell | |
| 2,811,133 | A | 10/1957 | Heino | |
| 2,872,712 | A | 2/1959 | Brown et al. | |
| 2,893,468 | A | 7/1959 | Fieroh | |
| 3,050,758 | A | 8/1962 | Wilkins | |
| 3,339,525 | A | 9/1967 | Roberts | |
| 3,341,351 | A | 9/1967 | Brewer | |
| 3,354,867 | A | 11/1967 | Pomper | |
| 3,440,790 | A | 4/1969 | Nerem | |
| 3,508,523 | A | 4/1970 | Meerleer | |
| 3,627,608 | A | 12/1971 | Steiner et al. | |
| 3,825,381 | A | 7/1974 | Dunning et al. | |
| 3,932,258 | A | 1/1976 | Brinkman et al. | |
| 3,998,181 | A | 12/1976 | Bellen et al. | |
| 4,004,774 | A | 1/1977 | Houston | |
| 4,054,477 | A | 10/1977 | Curran | |
| 4,076,880 | A | 2/1978 | Geschwender | |

(Continued)

FOREIGN PATENT DOCUMENTS

| | | |
|---|---|---|
| CH | 690 242 A5 | 6/2000 |
| CN | 2095236 U | 2/1992 |

(Continued)

OTHER PUBLICATIONS

Wallin, U. S. Appl. No. 61/287,428, entiitled, "Methods and Arrangements Relating to Surface Forming of Building Panels," filed Dec. 17, 2009.

(Continued)

*Primary Examiner* — Brian Glessner
*Assistant Examiner* — James Buckle, Jr.
(74) *Attorney, Agent, or Firm* — Buchanan Ingersoll & Rooney

(57) ABSTRACT

Floorboards comprising a core and a surface layer with curved edge portions, which are formed by a compression of the core.

21 Claims, 6 Drawing Sheets

U.S. PATENT DOCUMENTS

| | | | | |
|---|---|---|---|---|
| 4,084,996 | A | 4/1978 | Wheeler | |
| 4,102,975 | A | 7/1978 | Doerer | |
| 4,147,448 | A | 4/1979 | Jeffery | |
| RE30,233 | E | 3/1980 | Lane et al. | |
| 4,290,248 | A | 9/1981 | Kemerer et al. | |
| 4,612,074 | A | 9/1986 | Smith | |
| 4,645,481 | A | 2/1987 | Klapp | |
| 4,716,700 | A | 1/1988 | Hagemeyer | |
| 4,751,957 | A | 6/1988 | Vaught | |
| 4,850,838 | A | 7/1989 | Wagner et al. | |
| 5,096,408 | A | 3/1992 | Bielfeldt | |
| 5,111,579 | A | 5/1992 | Andersen | |
| 5,190,088 | A * | 3/1993 | Thomassen et al. | 144/361 |
| 5,213,819 | A | 5/1993 | Bielfeldt | |
| 5,349,796 | A | 9/1994 | Meyerson | |
| 5,497,589 | A | 3/1996 | Porter | |
| 5,582,906 | A | 12/1996 | Romesberg et al. | |
| 5,587,218 | A | 12/1996 | Betz | |
| 5,613,894 | A | 3/1997 | Delle Vedove | |
| 5,641,553 | A | 6/1997 | Tingley | |
| 5,671,575 | A | 9/1997 | Wu | |
| 5,755,068 | A | 5/1998 | Ormiston | |
| 6,101,778 | A | 8/2000 | Martensson | |
| 6,115,926 | A | 9/2000 | Robell | |
| 6,126,883 | A | 10/2000 | Troetscher et al. | |
| 6,146,252 | A | 11/2000 | Martensson | |
| 6,180,211 | B1 * | 1/2001 | Held | 428/172 |
| 6,345,481 | B1 | 2/2002 | Nelson | |
| 6,374,880 | B2 * | 4/2002 | Macpherson et al. | 144/350 |
| 6,401,415 | B1 | 6/2002 | Garcia | |
| 6,446,405 | B1 | 9/2002 | Pervan | |
| 6,532,709 | B2 | 3/2003 | Pervan | |
| 6,617,009 | B1 * | 9/2003 | Chen et al. | 428/195.1 |
| 6,679,011 | B2 | 1/2004 | Beck et al. | |
| 6,766,622 | B1 | 7/2004 | Thiers | |
| 6,769,218 | B2 | 8/2004 | Pervan | |
| 6,786,019 | B2 * | 9/2004 | Thiers | 52/589.1 |
| 6,833,039 | B2 | 12/2004 | Andersen et al. | |
| 6,922,964 | B2 | 8/2005 | Pervan | |
| 7,022,189 | B2 | 4/2006 | Delle Vedove et al. | |
| 7,047,697 | B1 | 5/2006 | Heath | |
| 7,101,438 | B2 | 9/2006 | Suzuki et al. | |
| 7,137,229 | B2 | 11/2006 | Pervan | |
| 7,584,583 | B2 | 9/2009 | Bergelin et al. | |
| 2002/0014047 | A1 * | 2/2002 | Thiers | 52/313 |
| 2002/0023702 | A1 | 2/2002 | Kettler | |
| 2002/0100231 | A1 | 8/2002 | Miller et al. | |
| 2002/0189183 | A1 | 12/2002 | Ricciardelli | |
| 2003/0041545 | A1 | 3/2003 | Stanchfield | |
| 2003/0101674 | A1 | 6/2003 | Pervan | |
| 2003/0159385 | A1 * | 8/2003 | Thiers | 52/311.1 |
| 2004/0031227 | A1 | 2/2004 | Knauseder | |
| 2004/0035077 | A1 | 2/2004 | Martensson | |
| 2004/0035078 | A1 | 2/2004 | Pervan | |
| 2004/0062937 | A1 | 4/2004 | Lyons | |
| 2004/0108625 | A1 * | 6/2004 | Moder et al. | 264/510 |
| 2004/0177584 | A1 | 9/2004 | Pervan | |
| 2004/0182036 | A1 | 9/2004 | Sjoberg et al. | |
| 2004/0244611 | A1 | 12/2004 | Ramcke | |
| 2004/0255541 | A1 | 12/2004 | Thiers et al. | |
| 2005/0028474 | A1 | 2/2005 | Kim | |
| 2005/0138881 | A1 | 6/2005 | Pervan | |
| 2005/0161468 | A1 | 7/2005 | Wagner | |
| 2005/0166514 | A1 | 8/2005 | Pervan | |
| 2005/0235593 | A1 | 10/2005 | Hecht | |
| 2005/0281997 | A1 | 12/2005 | Grah | |
| 2006/0048474 | A1 | 3/2006 | Pervan | |
| 2006/0073320 | A1 | 4/2006 | Pervan | |
| 2006/0099386 | A1 | 5/2006 | Smith | |
| 2006/0110490 | A1 | 5/2006 | Nien | |
| 2006/0144004 | A1 | 7/2006 | Nollet et al. | |
| 2006/0179773 | A1 | 8/2006 | Pervan | |
| 2006/0260253 | A1 | 11/2006 | Brice | |
| 2007/0175143 | A1 | 8/2007 | Pervan et al. | |
| 2007/0175144 | A1 | 8/2007 | Hakansson | |
| 2007/0175148 | A1 | 8/2007 | Bergelin | |
| 2007/0175156 | A1 | 8/2007 | Pervan et al. | |
| 2007/0232205 | A1 | 10/2007 | Delle Vedove | |
| 2008/0000179 | A1 | 1/2008 | Pervan | |
| 2008/0000183 | A1 | 1/2008 | Bergelin | |
| 2008/0000417 | A1 | 1/2008 | Pervan | |
| 2008/0005989 | A1 | 1/2008 | Pervan et al. | |
| 2008/0066425 | A1 | 3/2008 | Jacobsson et al. | |
| 2008/0120938 | A1 | 5/2008 | Jacobsson | |
| 2008/0263975 | A1 | 10/2008 | Mead | |
| 2009/0155612 | A1 | 6/2009 | Pervan et al. | |
| 2010/0092731 | A1 | 4/2010 | Pervan et al. | |
| 2010/0300030 | A1 | 12/2010 | Pervan et al. | |
| 2012/0233953 | A1 | 9/2012 | Pervan et al. | |

FOREIGN PATENT DOCUMENTS

| | | | |
|---|---|---|---|
| CN | 1376230 | A | 10/2002 |
| DE | 199 07 939 | C1 | 5/2000 |
| DE | 100 32 204 | C1 | 7/2001 |
| DE | 100 08 166 | A1 | 9/2001 |
| DE | 100 08 166 | C2 | 9/2001 |
| DE | 100 34 407 | C1 | 10/2001 |
| DE | 100 57 901 | A1 | 6/2002 |
| DE | 202 06 460 | U1 | 8/2002 |
| DE | 102 32 508 | C1 | 12/2003 |
| DE | 203 14 850 | U1 | 1/2004 |
| DE | 203 17 527 | U1 | 1/2004 |
| DE | 20 2004 001 038 | U1 | 4/2004 |
| EP | 0 487 925 | A1 | 6/1992 |
| EP | 0 661 135 | B1 | 12/1998 |
| EP | 1 048 423 | A2 | 11/2000 |
| EP | 1 215 352 | A2 | 6/2002 |
| EP | 1 228 812 | A1 | 8/2002 |
| EP | 1 338 344 | A2 | 8/2003 |
| EP | 1 357 239 | A2 | 10/2003 |
| EP | 1 357 239 | A3 | 10/2003 |
| EP | 1 437 457 | A2 | 7/2004 |
| EP | 1 593 795 | A1 | 11/2005 |
| EP | 1 691 005 | A1 | 8/2006 |
| EP | 1 971 735 | | 7/2007 |
| FR | 2 846 023 | A | 4/2004 |
| GB | 1 394 621 | A | 5/1975 |
| GB | 2 256 023 | A | 11/1992 |
| JP | 48-071434 | A | 9/1973 |
| JP | 49-031028 | B | 8/1974 |
| JP | 50-151232 | A | 12/1975 |
| JP | 55-099774 | U | 7/1980 |
| JP | 57-162668 | A | 10/1982 |
| JP | 57 185110 | A | 11/1982 |
| JP | 6-280376 | A | 10/1994 |
| JP | 8-033861 | A | 2/1996 |
| JP | 8-086080 | A | 4/1996 |
| JP | 9-88315 | A | 3/1997 |
| JP | 2000-079602 | A | 3/2000 |
| JP | 2000-226932 | A | 8/2000 |
| JP | 2001-179710 | A | 7/2001 |
| JP | 2001-254503 | A | 9/2001 |
| JP | 2001-260107 | A | 9/2001 |
| JP | 2002-276139 | a | 9/2002 |
| JP | 2002-371635 | A | 12/2002 |
| JP | 2003-126759 | A | 5/2003 |
| JP | 2003-200405 | A | 7/2003 |
| JP | 2003200405 | A * | 7/2003 |
| JP | 2004-027626 | A | 1/2004 |
| JP | 2007-170059 | A | 7/2007 |
| KR | 2007-000322 | A | 1/2007 |
| SE | 525 661 | C2 | 3/2005 |
| SU | 1680359 | A1 | 9/1991 |
| WO | WO 94/26999 | A1 | 11/1994 |
| WO | WO 97/19232 | A1 | 5/1997 |
| WO | WO 97/47834 | A1 | 12/1997 |
| WO | WO 01/02103 | A2 | 1/2001 |
| WO | WO 01/96688 | A1 | 12/2001 |
| WO | WO 02/055809 | A1 | 7/2002 |
| WO | WO 02/055810 | A1 | 7/2002 |
| WO | WO 02/060691 | A1 | 8/2002 |
| WO | WO 03/012224 | A1 | 2/2003 |
| WO | WO 03/025307 | A1 | 3/2003 |
| WO | WO 03/035352 | A1 | 5/2003 |
| WO | WO 03/070384 | A1 | 8/2003 |
| WO | WO 03/078761 | A1 | 9/2003 |
| WO | WO 03/099461 | A1 | 12/2003 |

| | | | |
|---|---|---|---|
| WO | WO 2004/053257 | A1 | 6/2004 |
| WO | WO 2004/053257 | A8 | 12/2004 |
| WO | WO 2005/068747 | A1 | 7/2005 |
| WO | WO 2005/110677 | A1 | 11/2005 |
| WO | WO 2006/008578 | A1 | 1/2006 |
| WO | WO 2006/031169 | A1 | 3/2006 |
| WO | WO 2006/038867 | A1 | 4/2006 |
| WO | WO 2006/043893 | A1 | 4/2006 |
| WO | WO 2006/066776 | A2 | 6/2006 |
| WO | WO 2006/088417 | A2 | 8/2006 |
| WO | WO 2006/113757 | A2 | 10/2006 |
| WO | WO 2007/081260 | A1 | 7/2007 |
| WO | WO 2008/033081 | A1 | 3/2008 |

OTHER PUBLICATIONS

Wallin, Magnus, U.S. Appl. No. 12/971,305, entitled "Methods and Arrangements Relating to Surface Forming of Building Panels," filed in the U.S. Patent and Trademark Office on Dec. 17, 2010.

U.S. Appl. No. 12/971,305, Wallin.

Pervan, Darko, et al., U.S. Appl. No. 11/521,439, entitled "Device and Method for Compressing an Edge of a Building Panel and a Building Panel with Compressed Edges," filed Sep. 15, 2006.

European Search Report issued in related EP 05 00 3173, The Hague, Jul. 11, 2005.

International Search Report and Written Opinion issued in related PCT/SE2006/000209, ISA Stockholm, SE, Aug. 15, 2006.

Pervan, Darko, et al., U.S. Appl. No. 13/045,631, entitled "Floorboards with Decorative Grooves," filed in the U. S. Patent and Trademark Office on Mar. 11, 2011.

Bergelin, Marcus, et al., U.S. Appl. No. 13/046,011, entitled "Resilient Groove," filed in the U. S. Patent and Trademark Office on Mar. 11, 2011.

U.S. Appl. No. 13/045,631, Pervan, et al.

U.S. Appl. No. 13/046,011, Bergelin, et al.

Bergelin, Marcus, et al., U.S. Appl. No. 13/552,357 entitled "Resilient Groove," filed in the U.S. Patent and Trademark Office on Jul. 18, 2012.

U.S. Appl. No. 13/552,357, Bergelin, et al.

Pervan, Darko, et al., U.S. Appl. No. 13/667,770, entitled "Appliance and Method for Surface Treatment of a Board Shaped Material and Floorboard," filed in the U.S. Patent and Trademark Office on Nov. 2, 2012.

U.S. Appl. No. 13/667,770, Pervan et al.

* cited by examiner

KNOWN TECHNOLOGY

BUILDING PANEL WITH COMPRESSED EDGES AND METHOD OF MAKING SAME

TECHNICAL FIELD

The present invention generally relates to building panels, especially floorboards, which have a wood fiber based core, a surface layer and compressed curved edge portions. More particularly, the present invention relates to interlocked building panels with compressed edge portions located below the panel surface. The invention relates to panels with such edge portions and to a method to produce such panels.

FIELD OF APPLICATION OF THE INVENTION

The present invention is particularly suitable for use in floating floors, which are formed of floorboards comprising a wood fiber based core with a surface layer and which are preferably joined mechanically with a locking system integrated with the floorboard. A floorboard with a mechanical locking system has a rather advanced edge profile and curved edge portion which are more difficult produce than in traditional furniture components. The following description of prior-art technique, problems of known systems and objects and features of the invention will therefore, as a non-restrictive example, be aimed above all at this field and in particular to laminate flooring with mechanical locking systems. However, it should be emphasized that the invention can be used in optional floorboards with optional locking systems, where the floorboards have a core and at least one surface layer and where these two parts are possible to be formed with a pressure force applied to the surface layer. The invention can thus also be applicable to, for instance, floors with one or more surface layers of wood applied on a wood fiber core. The present invention could also be used in building panels i.e. wall panels, ceilings and floor strips such as dilatation profiles, transition profiles or finishing profiles.

DEFINITIONS OF SOME TERMS

In the following text, the visible surface of the installed floorboard is called "front side", while the opposite side is called "rear side". "Horizontal plane" relates to a plane, which extends along the outer flat parts of the surface layer at the front side. "Vertical plane" relates to a plane, which is perpendicular to the horizontal plane and at an outer edge of the surface layer. By "up" is meant towards front side, by "down" towards rear side, by "vertical" parallel with the vertical plane and by "horizontal" parallel with the horizontal plane.

By "edge portion" is meant a part of the edge, which is below the horizontal plane. By "floor surface" is meant the outer flat parts of the surface layer along the horizontal plane. By "edge surface" is meant the surface of the edge portion. By "locking system" is meant cooperating connecting means, which interconnect the floorboards vertically and/or horizontally. By "mechanical locking system" is meant that joining can take place without glue.

BACKGROUND OF THE INVENTION, PRIOR-ART TECHNIQUES AND PROBLEMS THEREOF

Laminate floors and other similar floorboards are made up of one or more upper layers of decorative laminate, decorative plastic material or wood veneer, an intermediate core of wood fiber based material or plastic material and preferably a lower balancing layer on the rear side of the core.

Laminate flooring usually consists of a core of a 6-9 mm fiberboard, a 0.2-0.8 mm thick upper decorative surface layer of laminate and a 0.1-0.6 mm thick lower balancing layer of laminate, plastic, paper or like material. The surface layer provides appearance and durability to the floorboards. The core provides stability, and the balancing layer keeps the board plane when the relative humidity (RH) varies during the year. The floorboards are laid floating, i.e. without gluing, on an existing subfloor. Traditional hard floorboards in floating flooring of this type are usually joined by means of glued tongue-and-groove joints.

In addition to such traditional floors, floorboards have been developed which do not require the use of glue and instead are joined mechanically by means of so-called mechanical locking systems. These systems comprise locking means, which lock the boards horizontally and vertically. The mechanical locking systems can be formed by machining of the core. Alternatively, parts of the locking system can be formed of a separate material, which is integrated with the floorboard, i.e., joined with the floorboard in connection with the manufacture thereof.

The most common core material is a fiberboard with high density and good stability, usually called HDF—High Density Fiberboard. Sometimes also MDF Medium Density Fiberboard is used as core. MDF and HDF contain ground wood fibers, which by means of binding agents are combined into a sheet material.

Laminate flooring and also many other floorings with a surface layer of plastic, wood, veneer, cork and the like are produced in several steps. As shown in FIG. 1*a*-1*d* the surface layer and the balancing layer is produced in a separate step and are then applied to a core material by for example gluing a previously manufactured decorative layer and balancing layer to a fiberboard. Such a production process is used when a floor panel has a surface of a decorative high pressure laminate (HPL) which is made in a separate operation where a plurality of sheets of paper impregnated with a thermosetting resin, such as melamine and/or phenol are compressed under high pressure and at a high temperature.

The currently most common method when making laminate flooring, however, is the direct pressure laminate (DPL) method which is based on a more modern principle where both manufacture of the decorative laminate layer and the fastening to the fiberboard take place in one and the same manufacturing step. One or more papers impregnated with a thermosetting resin such as melamine are applied directly to the board and pressed together under pressure and heat without any gluing.

FIGS. 1*a*-1*d* shows how laminate flooring is produced according to known technology. As a rule, the above methods result in a floor element (3 in FIG. 1*b*) in the form of a large laminated board, which is then sawn into several individual floor panels (2 in FIG. 1*c*), which are then machined to floorboards (1 in FIG. 1*d*). The floor panels are individually machined along their edges to floorboards with mechanical locking systems on the edges. The machining of the edges is carried out in advanced milling machines where the floor panel is exactly positioned between one or more chains and belts or similar, so that the floor panel can be moved at high speed and with great accuracy past a number of milling motors, which are provided with diamond cutting tools or metal cutting tools, which machine the edge of the floor panel. By using several milling motors operating at different angles, advanced profiles can be formed at speeds exceeding 100 m/min and with an accuracy of ±0.02 mm.

The upper edges of the floorboards are in most cases very sharp and perpendicular to the floor surface and in the same plane as the floor surface.

Recently laminate floors have been developed with decorative grooves or bevels at the edges, which looks like a real gap or a bevel between solid wood floor such as planks or parquet strips.

It is known that such edges cold be made in several different ways.

In recent years, laminate floors, which are imitations of stones, tiles and the like, have become more and more common. It is known that the method which is used to manufacture decorative edge portions of such floors could also be used to produce edge portions which look like a gap in solid wood floors. This is shown in FIGS. 2*a* and 2*b*. The starting material is a decorative paper with printed edge portions which is impregnated with melamine resin. Uncontrolled swelling takes place in this operation. In the subsequent lamination, the decorative impregnated paper is placed on a core and lamination takes place against an embossed metal sheet, which forms a depression (20) in those parts of the floor element (3) where edge portions are to be formed. This is shown in FIG. 2*a*. The result is a floor element (1,1') whose front side has an embedded or embossed edge pattern corresponding to the intended edge portions between floorboards, as shown in FIG. 2*b*.

This manufacturing method suffers from a number of problems, which are above all related to difficulties in positioning the decorative paper and metal sheets in connection with laminating and the difficulty in positioning floor element and floor panels in the subsequent sawing and machining of the edges. The result is a floor panel with edge portions, which show considerable and undesired variations in structure and design as shown in FIG. 2*b*. Another problem is that this method is only suitable for embossed textures which are less than about 0.2 mm deep and which cannot be made deeper than the thickness of the surface layer. Further disadvantages are that although the edge is below the floor surface, it is sharp and parallel with the surface.

FIGS. 2*c* and 2*d* show another method. Decorative edge portions could be made in connection with the machining of the edges of the floor panel 1, 1'. Laminating and sawing of the floor element (3) can then take place without any specific requirements as to alignment, and swelling problems do not occur. The decorative and embedded edge portion can be provided by part of the decorative surface layer being removed so that the reinforcing layer of the laminate becomes visible (FIG. 2*d*). Alternatively, the core (30) itself can be used to create the decorative embedded edge portion. This is shown in FIG. 3*a*. The surface layer has been removed and the core (30) is uncovered within areas that are to constitute the decorative edge portion (20). A decorative grove could be made on only one edge as shown in FIG. 3*a*.

The most common method is shown in FIG. 3*b*. A part of the edge portion of a floorboard (1, 1') has been formed as a bevel 20 and this bevel is than in a separate operation covered with a separate material such as a tape, a plastic strip or it could be colored, printed etc. Separate materials are complicated and costly to apply and it is not possible to make an edge portion with the same design and structure as the floor surface. Such edge portion has considerable lower abrasion resistance and inferior moisture properties than the floor surface. The production method is rather slow and several application unites are needed to meet the speed of a modern production line for laminate floorings.

Another method is shown in FIG. 3*c*. The edge portion (20) is formed in a separate material, which has been inserted or extruded into a groove. This method has the same disadvantages as the method described above.

FIG. 3*d* show that a rounded edge portion (20) could be produced with the well known postforming method used for furniture components. A postforming laminate surface (31) of HPL, which is so flexible that it can be formed after the production of the laminated sheet, could be glued to an already machined floorboard (1). In a second production step the edge could be heated and the laminate could be bent and glued around the edge portion. This method would be very complicated, costly and is not used in laminate floorings.

The principles of the present invention are directed to edge portions in building panels, which overcome one or more of the limitations and disadvantages of the prior art.

These and other objects of the invention are achieved by floorboards, and manufacturing methods having the features that are stated in the independent claims. The dependent claims define particularly preferred embodiments of the invention.

SUMMARY

An objective of this invention is to provide building panels, especially floorboards, with curved edge portions made in one piece with the surface layer, which could be produced more efficiently than present products on the market.

An additional purpose is to provide such panels with edge portions, which have improved design and abrasion properties.

To achieve these objectives, according to a first embodiment, a floorboard is provided, with locking system, a wood fiber based core and a surface layer arranged on the upper side of the core. The outer flat parts of the surface layer constituting a floor surface and a horizontal plane. A plane, perpendicular to the horizontal plane and at the edge of the surface layer, constitutes a vertical plane. The floorboard has an edge portion with an edge surface, which is located under the horizontal plane. The edge surface at the vertical plane is at a distance from the horizontal plane which constitutes an edge depth and which exceeds the thickness of the surface layer.

The floor surface and the edge surface are made in one piece of the same material. A part of the core in the edge portion under the edge surface adjacent to the vertical plane and at a vertical distance from the edge surface has a higher density than a part of the core under the floor surface adjacent to the edge portion and at the same vertical distance from the floor surface.

According to a second embodiment, a method is provided to make a floorboard, with a locking system, a wood fiber based core and a surface layer arranged on the upper side of the core. The outer flat parts of the surface layer constituting a floor surface and a horizontal plane. The floorboard has an edge portion with an edge surface, which is located under the horizontal plane. The method comprises the steps of:

Applying the surface layer on the core to form a floor element.

Cutting the floor element into floor panels.

Applying a pressure on the surface of an edge portion of the floor panel such that the core under the surface layer is compressed and the surface layer is permanently bended towards the rear side.

According to another aspect of the second principle, a method is provided to make a building panel, with a wood fiber based core and a surface layer arranged on the upper side of the core. The outer flat parts of the surface layer constituting a panel surface and a horizontal plane. The panel has an edge portion with an edge surface, which is located under the horizontal plane. The method comprises the steps of:

Applying the surface layer on the core to form a building element.

Cutting the building element into building panels.

Applying a pressure on the surface of an edge portion of the building panel such that the core under the surface layer is compressed and the surface layer is permanently bended towards the rear side of the core.

DESCRIPTION OF PREFERRED EMBODIMENTS

Figure 1A:
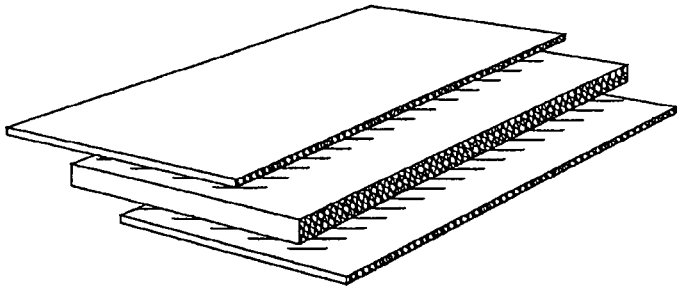
FIGS. 1*a-d* illustrate in different steps manufacture of a floorboard according to known technology.
Figure 1B:
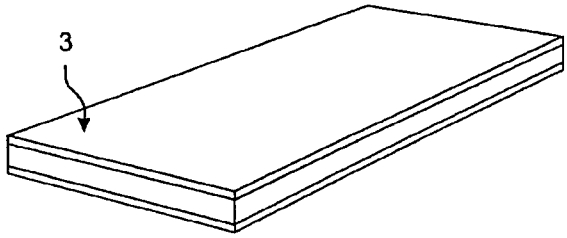
Figure 1C:
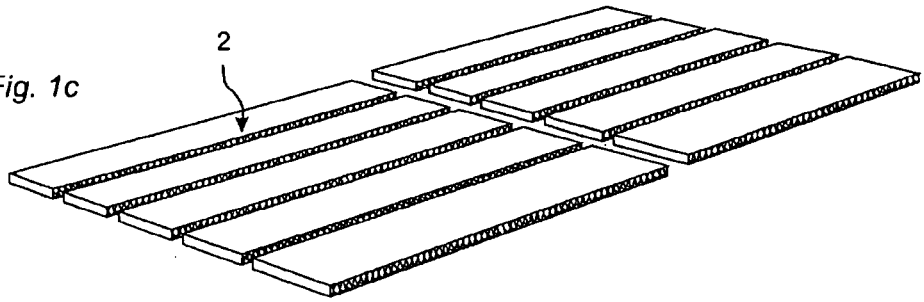
Figure 1D:
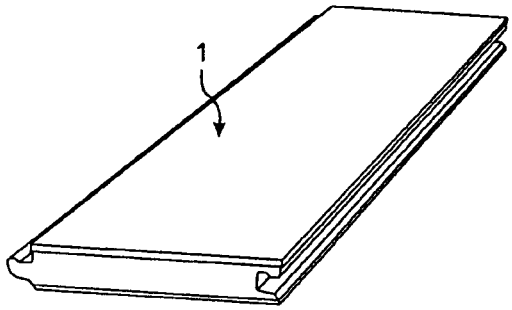
Figure 2A:
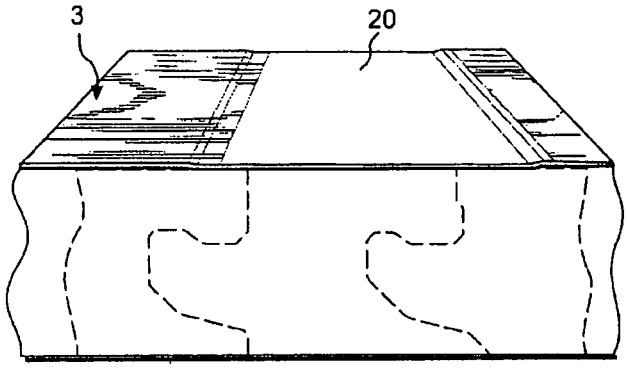
FIGS. 2*a-d* illustrate production methods to form edge portions according to known technology.
Figure 2B:
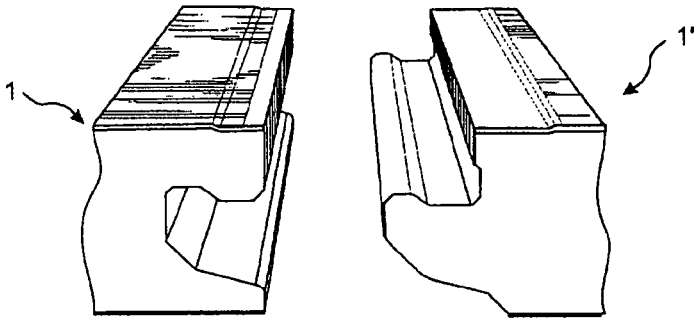
Figure 2C:
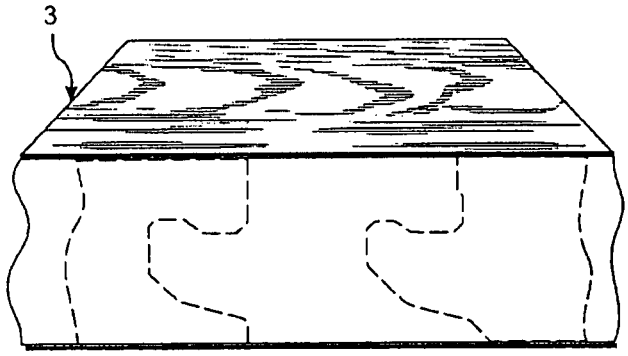
Figure 2D:
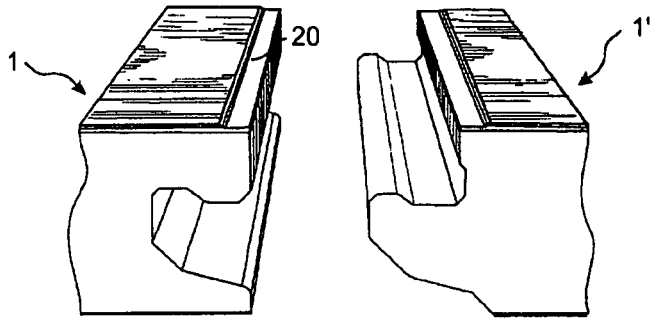
Figure 3A:
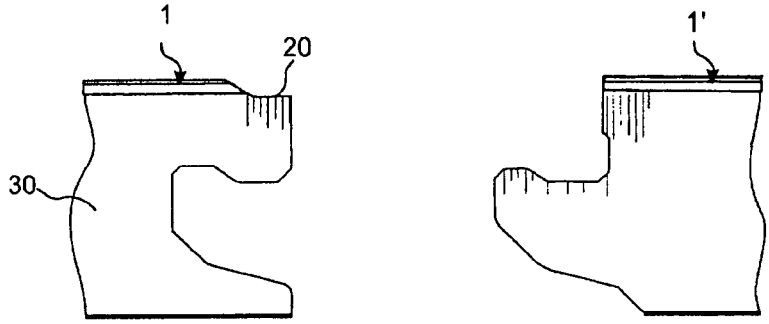
FIGS. 3*a-d* illustrate examples of different ways of manufacture of edge portions.
Figure 3B:
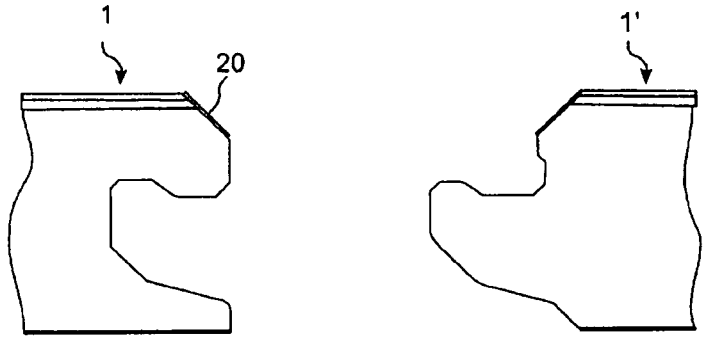
Figure 3C:
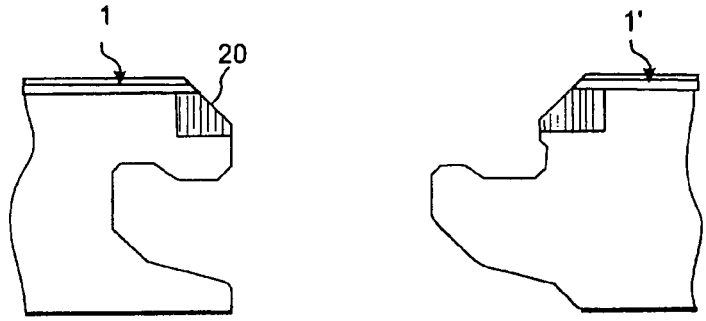
Figure 3D:
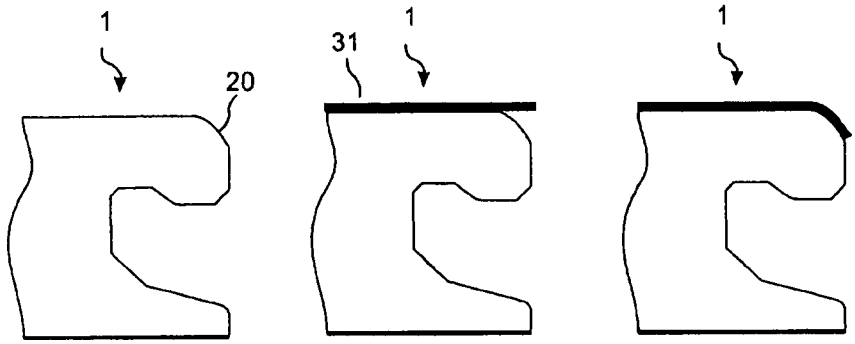
Figure 4A:
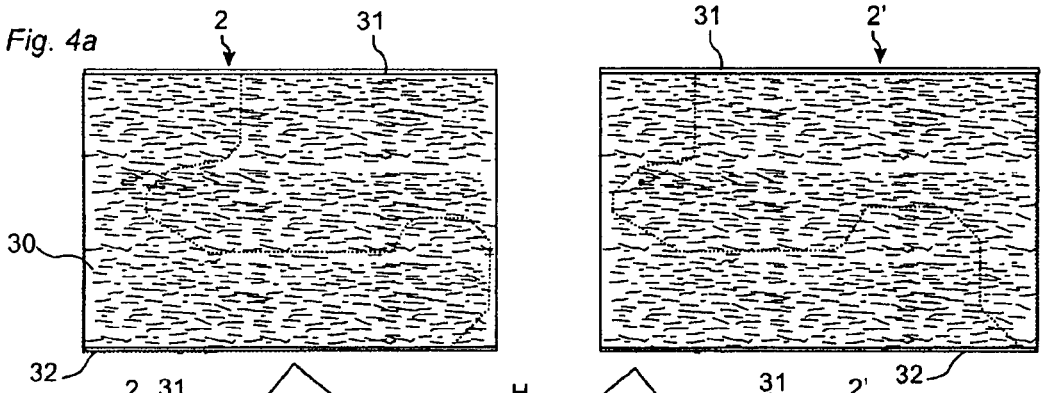
FIGS. 4*a-d* illustrate press forming of a edge portion according to an embodiment of the invention.
Figure 4B:
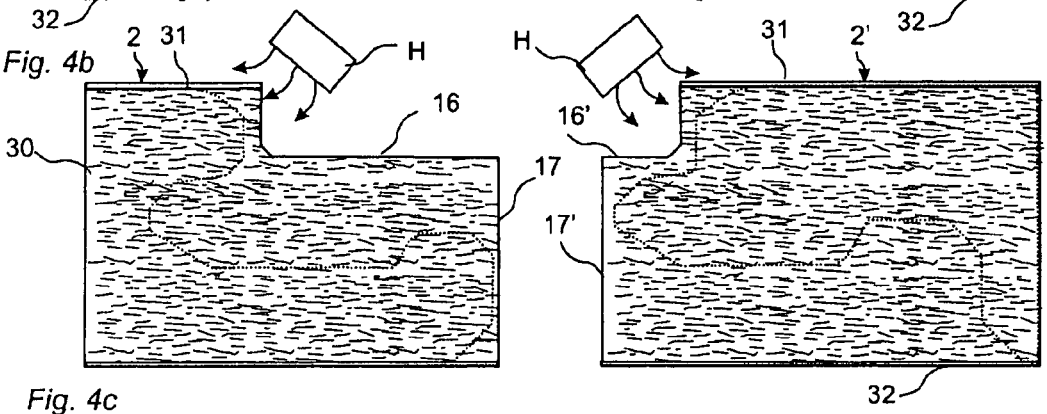
Figure 4C:
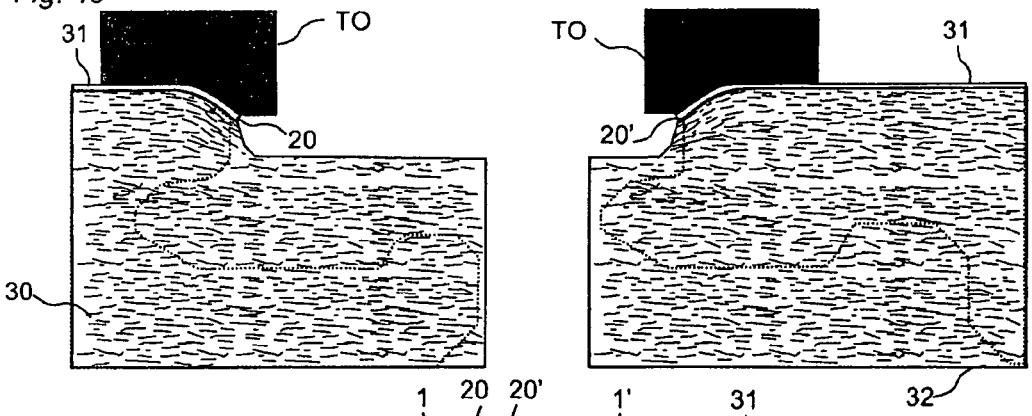

FIGS. 4*a*-4*c* show in four steps the manufacture of floorboards according to one embodiment of the invention. FIG. 4*a* shows two opposite edges of two essentially similar floor panels 2, 2' which are intended to be joined together with a mechanical locking system. The floorboards have a surface layer 31 of for example HPL, DPL or wood veneer, a core 30 of HDF and balancing layer 32. As shown in FIG. 4*b* an edge groove 16, 16' is formed at the upper side of the edge and a part of the surface layer 31 is removed. This could be done in a separate operation or in connection with the sawing of the floor element 3 into floor panels 2. If the surface layer 31 is laminate, at least a part of the edge groove 16,16' and the surface layer 31 adjacent to the edge groove 16,16' should preferably be heated with a suitable heating device H, such as for example heating nozzles which blow an even current of hot air. The temperature should exceed 100 degrees C. A preferable temperature is about 150-200 degrees C. In many applications a temperature of about 170 degrees C. gives the best result. Normal laminate quality could be used as a surface layer 31 and no special post forming quality is needed. If the surface layer 31 is a wood veneer, heating is preferably not required. The floor panel should preferably have a reference surface 17, 17' which could be used to position the floor panel correctly when edge portions and locking systems are formed. As shown in FIG. 4*c* the edge portions 20, 20' (each defined by an edge part of the core 30 and an edge part of the surface layer 32 affixed thereto) are then compressed with a compression tool TO which preferably is heated to similar temperatures as described above and is pressed against a top face of the surface layer's edge part. The compression tool TO could be a wheel and/or a pressure shoe or similar with a profile which preferably corresponds to the desired edge profile. Several tools could be used to form the edge portion in several steps. During the compression, the fibers in the core will be permanently compressed, the fiber orientations will in most cases change and the density in the edge portion 20 will increase. A change in the fiber orientation might be difficult to detect in some core materials. Increased density could however be measured with great accuracy. The edge portion 20 will be much stronger than traditional beveled edges in laminate flooring. The abrasion resistance will be similar as in the floor surface and the visible edge portion will have the same design and structure as the floor surface. The upper parts of the core 30 under the surface layer 31, which in a DPL flooring is impregnated with melamine and in a HPL flooring with glue, supports the laminate surface layer 31 during the bending and increases the flexibility of the laminate layer. The advantage is that ordinary qualities of thermosetting decorative laminates, which are rather brittle, could be used. HDF is particularly suitable for this kind of press forming with permanent compression according to the invention since the fiber structure and the binders, which are used in HDF, are ideal for this application. d to form the upper outer edge.

Figure 4D:
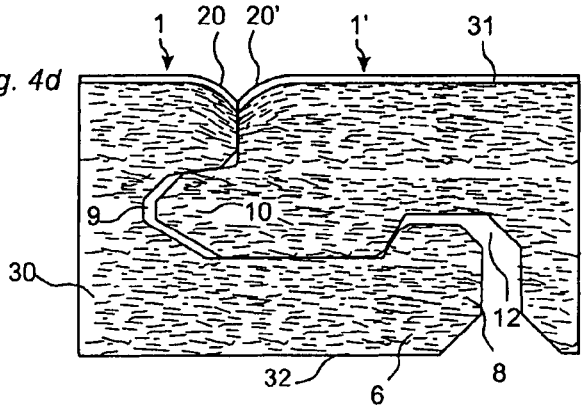

As shown in FIG. 4*d* a mechanical locking system with a tongue 10 and grove 9 for vertical locking and a strip 6 with a locking element 8 and a locking grove 12 for horizontal locking could easily be formed and positioned with high precision in relation to the compressed edge portions 20,20'. In this embodiment the press forming of the edge portions 20, 20' is made on the floor panel 2, which thereafter is machined to a floorboard 1. The advantage is that the forming of the mechanical locking system can be made with great accuracy and the press forming will not change the dimensions of the profile which in this embodiment is mainly the tongue 10 and the groove 9. Of course it is possible to form the edge portions 20, 20' on the floorboard after the machining of the edges, but this is more complicated and the compression possibilities are more limited. In most cases further machining is than required to form the upper outer edge.

Figure 5A:
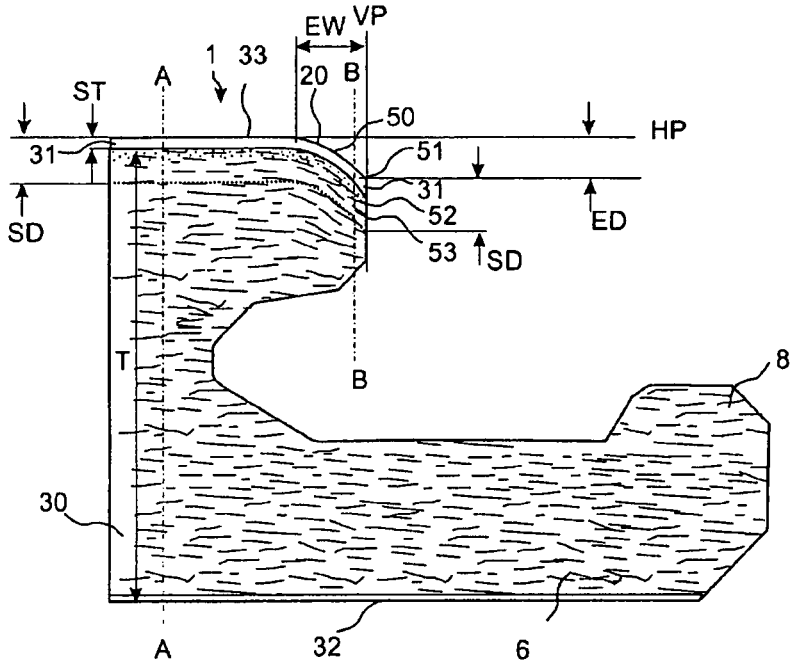
FIGS. 5*a-c* illustrate different properties of a convex curved edge portion according to embodiments of the invention.

FIG. 5*a* shows a cross section of a panel edge according to the invention. In this preferred embodiment the floor panel 1 has a surface layer 31 of DPL with a surface thickness ST and an outer edge 51. The upper flat part of the surface layer 31 constitutes a horizontal plane HP and a floor surface 33. A plane perpendicular to the horizontal plane and at the outer edge 51 of the surface layer 31, constitutes a vertical plane VP. The convex curved edge portion 20, which is located under the horizontal plane HP and which extends to the vertical plane VP has a edge width EW, measured parallel with the horizontal plane HP and an edge surface 50. The edge portion 20 has an edge depth ED measured vertically from the horizontal plane HP, which is equal to the distance SD from the horizontal plane HP to the outer edge 51 at the vertical plane VP. As shown in FIG. 5*a* the fibers in the edge portion 20 have been compressed and the fiber orientation have been changed such that the fibers are curved in the same direction as the edge surface 50 of the edge portion 20.

Several relationships are favorable in order to produce an edge portion (20) according to the invention.

Edge depth ED should preferably be larger than the surface layer thickness ST. In the most preferable embodiment edge depth ED should be larger than 2 or even 3 times the surface thickness ST. The method allows forming of edge portions 20 with edge depths ED exceeding 10 times the surface thickness ST.

The edge width EW should preferably be larger than the edge depth ED. In the most preferable embodiment edge width EW should be larger than 2 times the edge depth ED The edge depth ED should preferably be larger than 0.1 times the floorboard thickness T.

The thickness ST of the surface layer 31 should be 0.1-0.01 times the floor thickness T.

These relationships could be used independently or in combination.

Figure 5B:
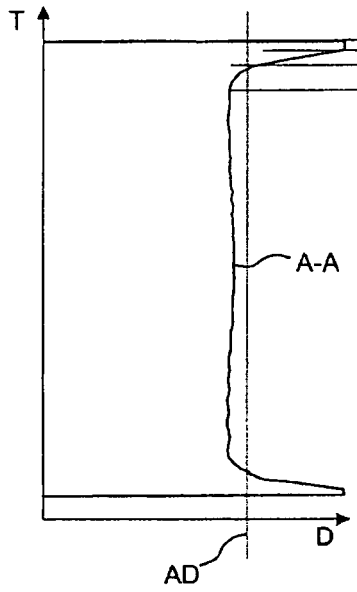
Figure 5C:
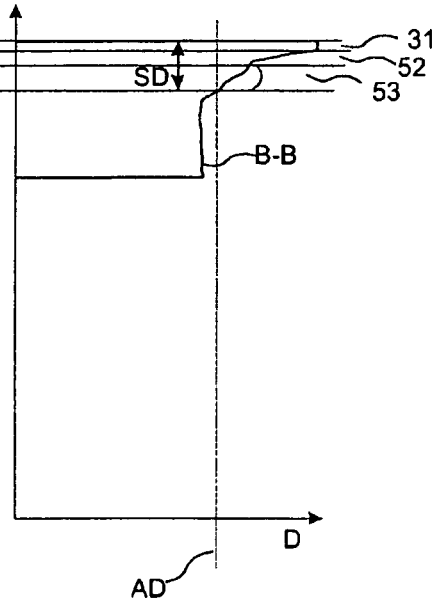

FIG. 5*b* shows the density D profile in a part (A-A) of a floorboard 1 which has not been compressed and FIG. 5*c* shows the density profile D in a compressed edge portion (B-B) of the same floorboard. Density profiles could be measured extremely accurately with a gamma beam. The distance between measuring points could be as small as 0.04 mm. In this example the surface layer 31 of laminate, which is about 0.2 mm thick, has a density of about 1300 kg/m3. Below the surface layer 31 there is a core portion 52 which in connection with the direct pressure lamination has been impregnated with melamine and where the density varies between about 1200-1000 kg/m3. Under this core portion 52 there is another portion 53 where the density is slightly higher than in the middle parts of the core 30. The average density is shown by the line AD. It should be emphasized that compression in wood fiber based board material always gives an increased density.

FIG. 5*c* shows the density profile in a compressed part B-B of the edge portion 20. A part of the core 30 in the edge portion adjacent to the vertical plane VP and at a vertical distance SD from the surface layer 31, has a higher density D than a part of the core which is under the floor surface adjacent to the edge portion 20 and at the same vertical distance SD from the surface layer 31. This is contrary to traditional postforming where the edge portion is machined and the surface layer is glued to the part of the core, which have the same or lower density.

Figure 6A:
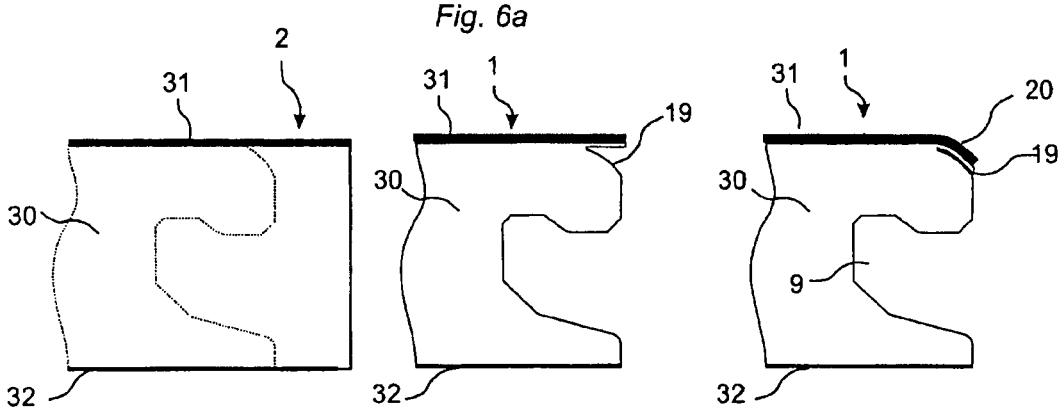
FIGS. 6*a-b* illustrate alternative methods to form embodiments of the invention.
Figure 6B:
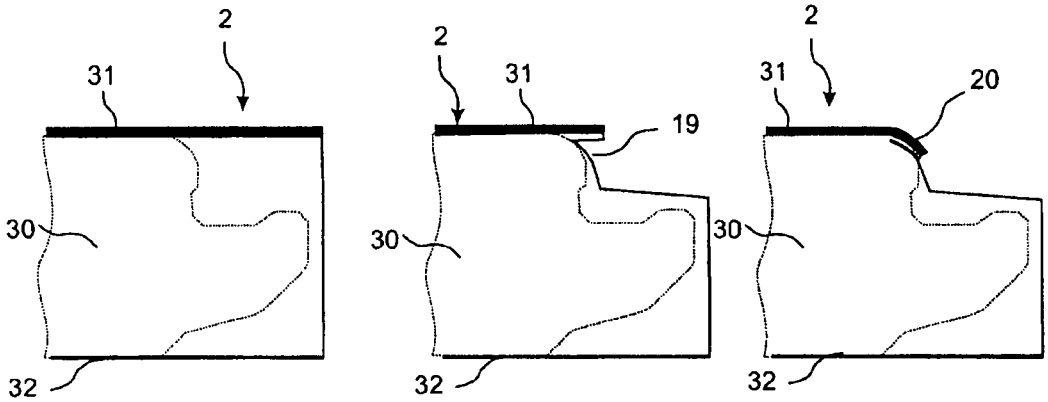

FIG. 6*a* shows an alternative method to form an edge portion 20 in a DPL flooring. A floorboard 1 is produced with an edge groove 19 under the surface layer 31. The upper part of the edge grove 19 consist of the surface layer 31 and a part of the core 30. This upper part of the edge grove 19 is folded against the lover part of the edge grove 19 and both parts are pressed and glued together. FIG. 6*b* shows that this method could be used to form an edge portion of a floor panel which is than machined to a floorboard. Both these methods are more complicated than the press forming since glue and separate machining is required. This method could be partly combined with the press forming and the core could be compressed in connection with the gluing.

Figure 7:
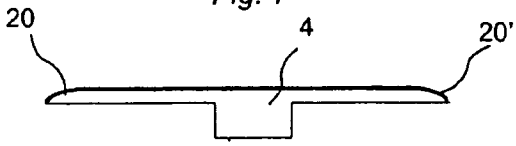
FIG. 7 illustrates a dilatation profile according to an embodiment of the invention.

FIG. 7 shows a dilatation profile 4 with press formed edge portions 20, 20', according to the invention.

Figure 8:
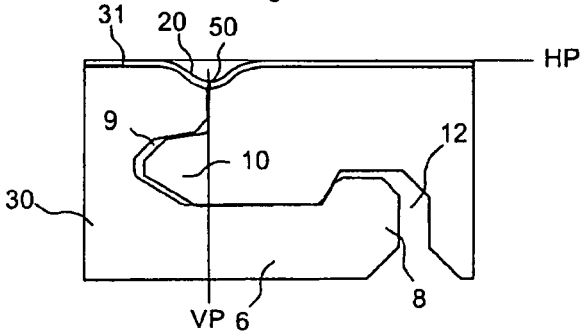
FIG. 8 illustrates an edge portion with a curved edge surface.

FIG. 8 shows a floorboard with edge portions 20 at opposite edges which are curved and where the outer adjacent parts of the edge surfaces 50 are essential parallel with the horizontal plane HP.

The invention is especially suitable to produce laminate floorings which look like solid wood floor strips with a width of about 5-10 cm and where compressed edge portions are only formed on the long sides. Such floorboards could also easily be made in random lengths since long press formed floor panels could be produced which are thereafter machined and cut to floorboards in different lengths.

A floor which consists of such floorboards will have many curved edge portions 20 and only very cost efficient production methods such as press forming could be used in order to obtain production costs which are competitive and lower than similar solid wood floors.

Press forming is very efficient and can easily meet the speed of modern profiling lines.

The method to compress the core with a surface layer of a laminate floor element, floor panel or floorboard or a similar building element panel according to the invention could be used to form embossed portions on other parts than the edges.

It will be apparent to those skilled in the art that various modifications and variations of the present invention can be made without departing from the spirit and scope of the invention. Thus, it is intended that the present invention include the modifications and variations of this invention provided they come within the scope of the appended claims and their equivalents.

What is claimed is:

1. A method of making a floorboard, comprising:

affixing a surface layer on a wood fiber based core to form a floor element, then cutting the floor element into floor panels, such that each floor panel includes an edge portion formed by an edge part of the core and an edge part of the surface layer affixed to the core's edge part, wherein a top face of the surface layer forms a floor surface lying in a horizontal plane, then applying pressure on a portion of the top face defined by the surface layer's edge part with a compression tool having a predetermined profile such that the core's edge part is compressed and said surface layer's edge part is permanently bent out of said plane, wherein said edge portion of said floor panel obtains an edge profile corresponding to the predetermined profile of the compression tool, with said portion of said top face defined by the surface layer's edge part being disposed under said plane, and then forming a mechanical locking system at the edge of the floorboard, wherein the surface layer extends to an outer edge of the compressed edge part, wherein an edge groove is formed at the edge of the floor panel before compression.

2. The method as claimed in claim 1, wherein the surface layer comprises paper sheets impregnated with a thermosetting resin.

3. The method as claimed in claim 1, wherein the surface layer is a wood veneer.

4. The method as claimed in claim 1, wherein the core is made of HDF.

5. The method as claimed in claim 4, wherein the edge portion is pressed under heat exceeding 100 degrees C.

6. The method as claimed in claim 4, wherein the edge portion is pressed under heat exceeding 160 degrees C.

7. The method as claimed in claim 1, wherein the outer edge of the compressed edge part is a vertical, planar surface.

8. A method of making a building panel, comprising:

affixing a surface layer on a wood fiber based core to form a building element, then cutting the building element into building panels, such that each building panel includes an edge portion formed by an edge part of the core and an edge part of the surface layer affixed to the core's edge part, wherein a top face of the surface layer forms a panel surface lying in a plane, then applying pressure on a portion of the top face defined by the surface layer's edge part with a compression tool having a predetermined profile such that the core's edge part is compressed and said surface layer's edge part is permanently bent out of said plane, wherein said edge portion of said building panel obtains an edge profile corresponding to the predetermined profile of the compression tool, with said portion of said top face defined by the surface layer's edge part being disposed under said plane, and then forming a mechanical locking system at the edge of the building panel, wherein the surface layer extends to an outer edge of the compressed edge part, wherein the surface layer comprises paper sheets impregnated with a thermosetting resin.

9. A method of making a floorboard, comprising:

affixing a surface layer comprising a paper laminate on a wood fiber based core to form a floor element, then cutting the floor element into floor panels, such that each floor panel includes an edge portion formed by an edge part of the core and an edge part of the surface layer affixed to the core's edge part, wherein a top face of the surface layer forms a floor surface lying in a horizontal plane, then applying pressure on a portion of the top face defined by the surface layer's edge part with a compression tool having a predetermined profile such that the core's edge part is compressed and said surface layer's edge part is permanently bent out of said plane, wherein said edge portion of said floor panel obtains an edge profile corresponding to the predetermined profile of the compression tool, with said portion of said top face defined by the surface layer's edge part being disposed under said plane, and after compressing the core's edge part, forming a mechanical locking system at the edge of the floor panel, wherein the paper laminate comprises paper sheets impregnated with a thermosetting resin, and an upper part of the core under the surface layer is impregnated with a material to increase the flexibility of the paper laminate.

10. The method as claimed in claim 9, wherein the outer edge of the compressed edge part is a vertical, planar surface.

11. The method as claimed in claim 9, further comprising applying the surface layer directly to the wood fiber based core and pressing them together under pressure and heat, and without any gluing.

12. The method as claimed in claim 9, wherein the upper part of the core under the surface layer is impregnated with melamine.

13. The method as claimed in claim 9, wherein the upper part of the core under the surface layer is impregnated with glue.

14. The method as claimed in claim 9, further comprising the step of making the paper laminate in a separate step, wherein the paper laminate is a high pressure laminate made in a separate operation where a plurality of sheets of paper impregnated with a thermosetting resin are compressed under high pressure and at a high temperature, and then affixed to the core.

15. The method as claimed in claim 9, wherein the step of affixing the paper laminate comprises both manufacture of the paper laminate and the fastening to the core take place in one and the same manufacturing step, wherein one or more papers impregnated with a thermosetting resin are applied directly to the core and pressed together under pressure and heat without any gluing.

16. A method of making a building panel, comprising:

affixing a surface layer comprising a paper laminate on a wood fiber based core to form a building element, then cutting the building element into building panels, such that each building panel includes an edge portion formed by an edge part of the core and an edge part of the surface layer affixed to the core's edge part, wherein a top face of the surface layer forms a panel surface lying in a plane, then applying pressure on a portion of the top face defined by the surface layer's edge part with a compression tool having a predetermined profile such that the core's edge part is compressed and said surface layer's edge part is permanently bent out of said plane, wherein said edge portion of said building panel obtains an edge profile corresponding to the predetermined profile of the compression tool, with said portion of said top face defined by the surface layer's edge part being disposed under said plane, and after compressing the core's edge part, forming a mechanical locking system at the edge of the building panel;

wherein the paper laminate comprises paper sheets impregnated with a thermosetting resin, and an upper part of the core under the surface layer is impregnated with a material to increase the flexibility of the paper laminate.

17. The method as claimed in claim 16, further comprising applying the surface layer directly to the wood fiber based core and pressing them together under pressure and heat, and without any gluing.

18. The method as claimed in claim 16, wherein the upper part of the core under the surface layer is impregnated with melamine.

19. The method as claimed in claim 16, wherein the upper part of the core under the surface layer is impregnated with glue.

20. The method as claimed in claim 16, further comprising the step of making the paper laminate in a separate step, wherein the paper laminate is a high pressure laminate made in a separate operation where a plurality of sheets of paper impregnated with a thermosetting resin are compressed under high pressure and at a high temperature, and then affixed to the core.

21. The method as claimed in claim 16, wherein the step of affixing the paper laminate comprises both manufacture of the paper laminate and the fastening to the core take place in one and the same manufacturing step, wherein one or more papers impregnated with a thermosetting resin are applied directly to the core and pressed together under pressure and heat without any gluing.

* * * * *